United States Patent [19]

Toft et al.

[11] Patent Number: 4,821,749

[45] Date of Patent: Apr. 18, 1989

[54] EXTRUDED TOBACCO MATERIALS

[75] Inventors: Howard C. Toft, Clemmons; Kenneth W. Smith; Carolyn R. Carpenter, both of Winston-Salem, all of N.C.

[73] Assignee: R. J. Reynolds Tobacco Company, Winston-Salem, N.C.

[21] Appl. No.: 147,626

[22] Filed: Jan. 22, 1988

[51] Int. Cl.[4] ..... A24B 3/14

[52] U.S. Cl. ..... 131/575; 131/297

[58] Field of Search ..... 131/370, 375, 297, 298

[56] References Cited

U.S. PATENT DOCUMENTS

| | | | |
|---|---|---|---|
| 1,156,609 | 10/1915 | Mewborne . | |
| 1,671,259 | 5/1928 | Schloesing . | |
| 2,769,734 | 7/1955 | Bandel . | |
| 3,203,432 | 8/1965 | Green et al. . | |
| 3,364,935 | 1/1968 | Moshy et al. . | |
| 3,386,449 | 6/1968 | Hind . | |
| 3,480,018 | 11/1969 | Fairchild . | |
| 3,742,962 | 7/1973 | Brochot . | |
| 3,803,004 | 4/1974 | Egri . | |
| 3,932,081 | 1/1976 | Buchmann et al. . | |
| 4,058,129 | 11/1977 | Béringer et al. | 131/375 |
| 4,068,671 | 1/1978 | Casey . | |
| 4,109,663 | 8/1978 | Maeda et al. . | |
| 4,153,063 | 5/1979 | Roselius et al. . | |
| 4,164,948 | 8/1979 | Beringer et al. . | |
| 4,215,706 | 8/1980 | Larson et al. . | |
| 4,333,484 | 6/1982 | Keritsis . | |
| 4,341,228 | 7/1982 | Keritsis et al. . | |
| 4,347,855 | 9/1982 | Lanzillotti et al. . | |
| 4,391,285 | 7/1983 | Burnett et al. . | |
| 4,448,208 | 5/1984 | Friedrich et al. . | |
| 4,510,950 | 4/1985 | Keritsis et al. . | |
| 4,598,721 | 7/1986 | Stiller et al. . | |
| 4,625,737 | 12/1986 | Keritsis et al. . | |
| 4,632,131 | 12/1986 | Burnett et al. . | |

FOREIGN PATENT DOCUMENTS

| | | |
|---|---|---|
| 248128 | 12/1987 | European Pat. Off. . |

*Primary Examiner*—V. Millin
*Assistant Examiner*—N. Paul

[57] ABSTRACT

Extruded tobacco has its chemical composition changed during the extrusion process. Divided tobacco and ammonia are introduced into an extruder. The combination of temperatures and pressures within the extruder provides for liberation of nicotine from the tobacco. The ammonia and liberated nicotine are removed from the extruder. In addition, the ammonia and sugars within the tobacco can react to further modify the chemical composition of the tobacco. Extrudate is collected separately from the liberated materials. In such a manner, tobacco can be reformed into an extruded shape while having its chemical composition altered.

31 Claims, 2 Drawing Sheets

EXTRUDED TOBACCO MATERIALS

BACKGROUND OF THE INVENTION

The present invention relates to the manufacture of smokable materials, and in particular, to the processing of tobacco products using extrusion technology.

Cigarettes are popular smoking articles which have a substantially cylindrical rod shaped structure and include a charge of tobacco material surrounded by a wrapper such as paper thereby forming a so-called "tobacco rod." It has become desirable to manufacture cigarettes having cylindrical filters aligned in an end-to-end relationship with the tobacco rod. Typically, filters are manufactured from fibrous materials such as cellulose acetate, and are attached to the tobacco rod using a circumscribing tipping material. Cigarettes often can include processed, reconstituted or reclaimed tobacco materials. Although numerous methods for processing, reconstituting or reclaiming tobacco materials are known, there has been interest in providing such materials using various extrusion techniques.

Numerous references address methods for providing extruded smokable materials. For example, U.S. Pat. No. 3,203,432 to Green et al proposes grinding tobacco to a small size, mixing the tobacco with water, and extruding the mixture into filamentary form. U.S. Pat. No. 4,598,721 to Stiller et al proposes producing crimped fiber pieces from tobacco waste using an extruder having a die head for producing filiform products and a rotating blade at the die head. U.S. Pat. No. 3,932,081 to Buchmann et al proposes extruding smokable fibers from a suspension of ground tobacco. U.S. Pat. No. 4,347,855 to Lanzillotti et al and U.S. Pat. No. 4,391,285 to Burnett et al propose extruding smoking articles having highly specific shapes and configurations as well as controlled porosities and densities. U.S. Pat. Nos. 4,510,950 and 4,625,737 to Keritsis et al propose providing foamed, extruded tobacco-containing smoking articles.

Although various methods for physically processing smokable materials exist, there does not appear to be known any specific manners or methods for providing controlled and significant composition changes to the tobacco material during extrusion. In order to efficiently and effectively provide smokable material of unique, improved or controlled smoking character or composition, it would be desirable to employ a method for significantly changing the chemical composition of tobacco material during an extrusion process.

SUMMARY OF THE INVENTION

The present invention relates to extruded smokable material. Preferably, smokable material is provided by extruding divided tobacco material. If desired, other filler materials can be processed with the tobacco material. In accordance with the present invention, filler material, at least a portion of which is tobacco material, and an agent capable of altering the chemical composition of the tobacco material are introduced into an extrusion apparatus and are subjected to extrusion conditions. The aforementioned agent is a material which is capable of modifying the chemical composition of the tobacco material, and/or displacing or otherwise releasing selected component(s) from the tobacco material. The filler material and aforementioned agent are subjected to extrusion conditions sufficient to allow the agent to act to provide the agent with the capability to chemically modify the tobacco material or to displace or otherwise release selected component(s) from the tobacco material. In particular, the amount of filler material relative to the aforementioned agent, the mixing action within the extrusion means, the moisture level, and the temperatures and pressures experienced within the extrusion means cause a modification of the tobacco material or certain amounts of selected component(s) to be effectively released from the tobacco material. Excess agent as well as component(s) which are liberated from the tobacco material within the extrusion means are collected separately from the resulting extrudate.

As used herein, and only for purposes of describing this invention, the term "displace" in referring to the displacement of selected component(s) from the tobacco material is meant that the tobacco material is relieved of the selected component(s) or that the selected component(s) are otherwise removed from the tobacco material to some degree. In particular, the selected component(s) can be released or eliminated to some degree from the tobacco material. For example, selected component(s) can be extracted, volatilized, or otherwise carried, liberated or driven from the tobacco material.

As used herein, and only for purposes of this invention, the term "modify" in referring to the modification of the chemical composition of the tobacco material is meant that the tobacco material undergoes a chemical change or is otherwise chemically altered to some degree.

The present invention allows for the processing of smokable material in an efficient and effective manner. Of particular interest is that tobacco can be processed to a desired physical shape or form while simultaneously altering its chemical composition to a significant degree. For example, flue-cured tobacco material can be contacted with ammonia within an extrusion means under conditions such that (i) a certain amount of nicotine is liberated or otherwise displaced from the tobacco, and (ii) the ammonia and reducing sugars of the flue-cured tobacco can react chemically thereby providing certain reaction flavors within the extruded material. Alternatively, Burley tobacco can be contacted with ammonia and an effective amount of a sugar additive (e.g., fructose or glucose) within an extrusion means under conditions such that (i) a certain amount of nicotine is liberated or otherwise displaced from the tobacco, and (ii) the ammonia and sugar can chemically react within the extruded material. In either case, the liberated nicotine and the resulting denicotinized extrudate are collected separately.

The resulting extruded smokable material can be employed using techniques known in the art. For example, the extrudate can be provided in a sheet-like form, further processed, treated with additives, blended with other materials, cut or otherwise processed to achieve the desired size, or the like. Most preferably, the extrudate is employed as cut filler or tobacco extender for the manufacture of cigarettes.

DETAILED DESCRIPTION OF THE PREFERRED EMBODIMENTS

Figure 1:
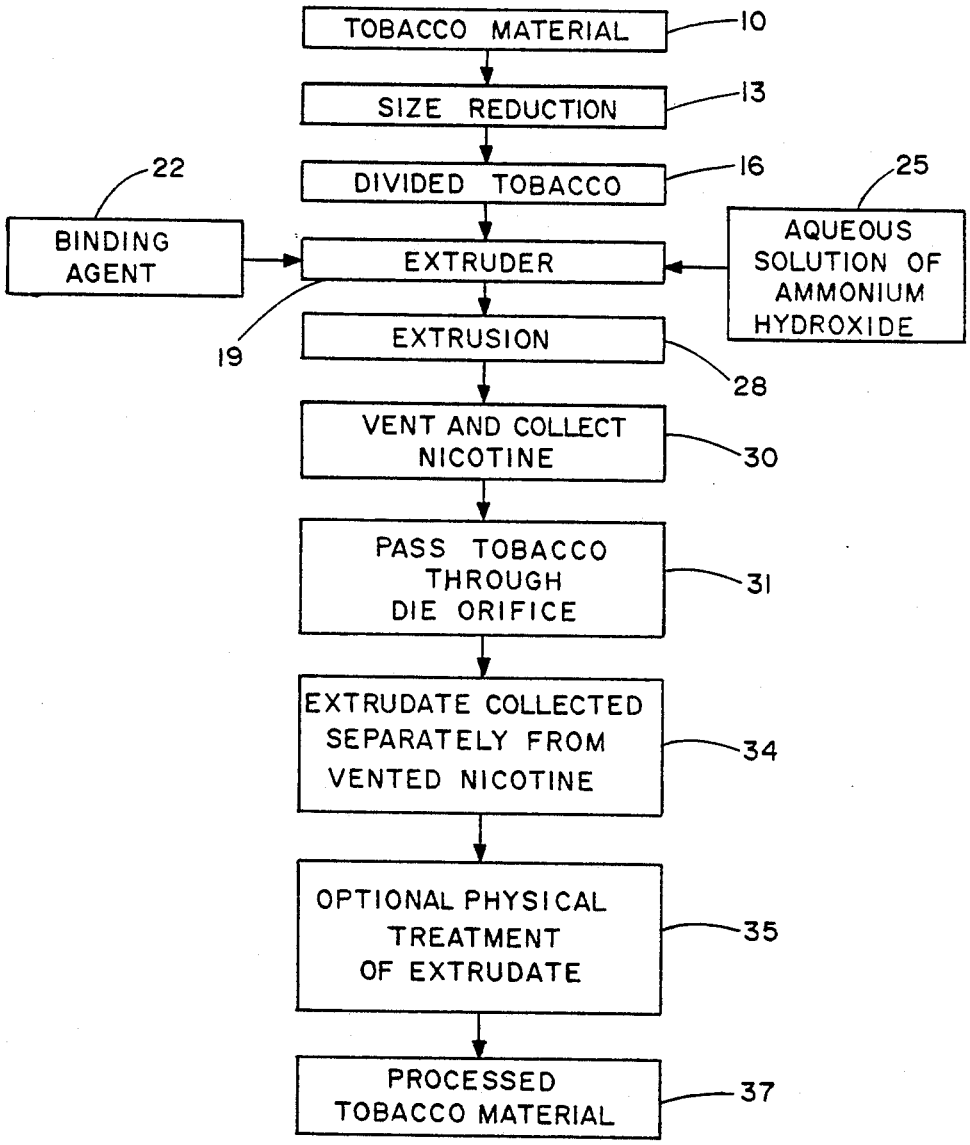
FIGS. 1 and 2 are schematic diagrams of preferred embodiments of the representative processing steps of this invention.
Figure 2:
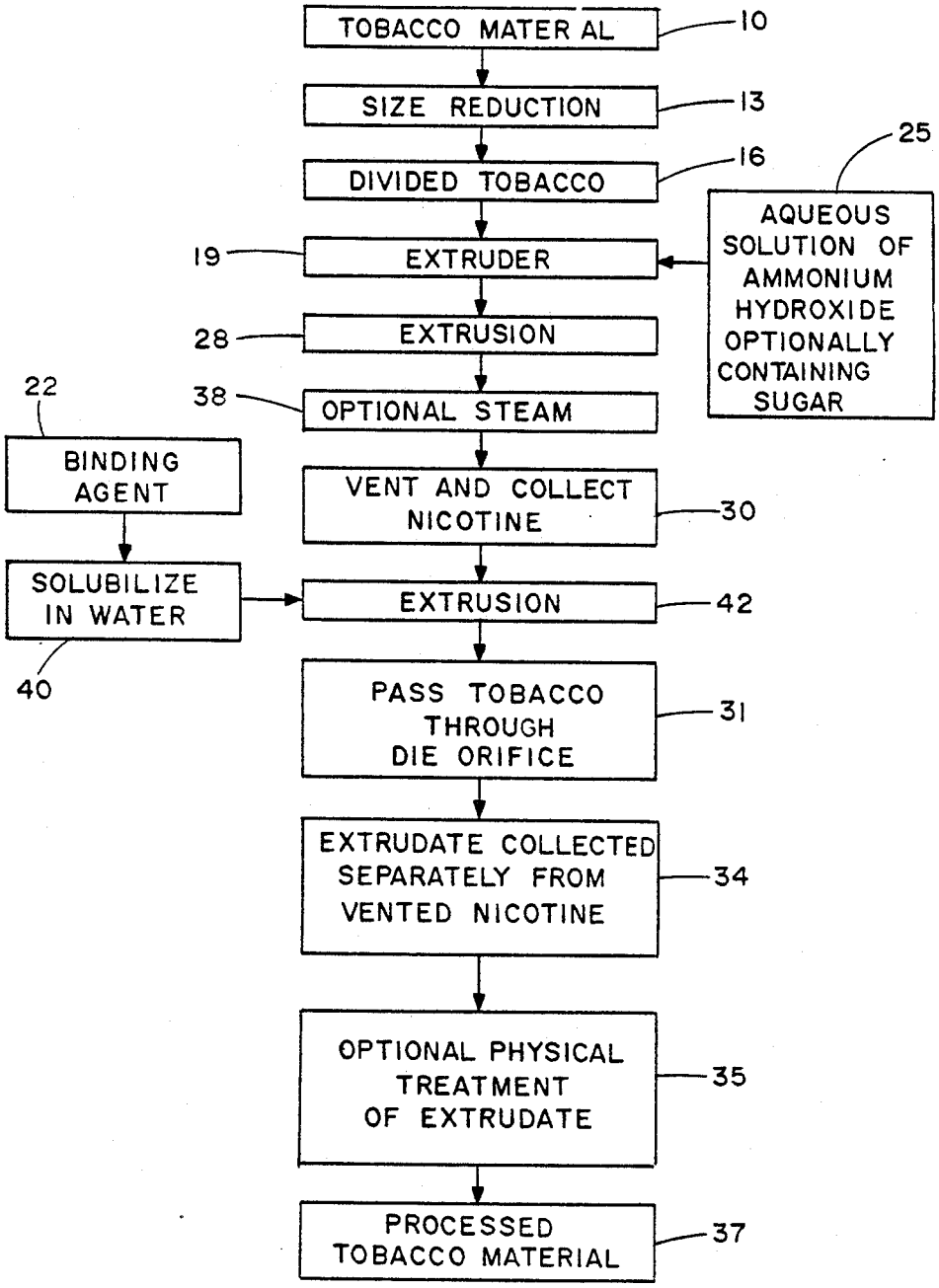

Referring to FIGS. 1 and 2, there are set forth schematic flow diagrams of representative preferred processing steps of the present invention. In particular, the flow diagrams set forth various processing steps for providing denicotinized tobacco materials.

Referring to FIG. 1, tobacco material 10 is subjected to a size reduction step 13 using a ball mill, or other suitable comminuting apparatus. The comminuted tobacco material 16 is transferred to, and metered into, the feed zone of an extruder 19. Binding agent 22 is metered into the feed zone of the extruder 19. The comminuted tobacco material 16 and binding agent 22 are dry blended within the extruder 19, and the desired level of moisture is metered into the mixture. The moisture conveniently is provided as an aqueous ammonium hydroxide solution 25. The resulting moist mixture is subjected to extrusion conditions 28 including elevated temperatures and pressures in order to provide a well mixed, semi-soft, semi-solid material while solubilizing and activating the binding agent. The temperatures and pressures within the extruder also are sufficient to provide for liberation of nicotine from the tobacco material. Gaseous components (e.g., such as water vapor, ammonia and nicotine) are vented in venting region 30 and collected upstream from the die 31 of the extruder. In particular, it is most desirable that the pressures within the extruder provide or a relatively high amount of moisture in the liquid state prior to the time that the gaseous components are released in the venting region. However, at the venting region 30, the pressure is maintained much lower relative to the region upstream along the extruder in order to facilitate removal of volatile materials from the extruded mixture. The semi-soft, semi-solid material is passed through opening(s) in die 31, and the resulting extrudate 34 is collected separately from the vented moisture, ammonia and nicotine. The manner in which the extrudate is collected can vary and depends upon the desired use of that material. If desired, the extrudate exiting the extruder die can be subjected to treatment using a roller system 35, or to other physical treatment. Such optional physical treatment is particularly desirable for mixtures having moisture contents below about 40 weight percent. The resulting material i cooled to ambient temperature to yield resilient processed tobacco material 37 having a nicotine content less than that of tobacco material 10.

Referring to FIG. 2, tobacco material 10 is subjected to a size reduction step 13. The resulting comminuted tobacco material 16 is transferred to, and metered into, the feed zone of the extruder 19. A desired level of aqueous ammonium hydroxide solution 25 is metered into the mixture. Optionally, the solution can contain an amount of a sugar such as glucose, fructose, or the like, particularly when the tobacco material is Burley tobacco or consists of a high level of Burley tobacco. The resulting moist mixture is subjected to extrusion conditions 28 including elevated temperatures and pressures in order to provide for liberation of nicotine from the tobacco material. Gaseous components (e.g., such as water vapor, ammonia and nicotine) are vented from the extruder at venting region 30 and collected upstream from the die 31 of the extruder. In particular, it is most desirable that the pressures within the extruder provide for a relatively high amount of moisture in the liquid state prior to the time that the gaseous components are released in the venting region. However, at the venting region 30, the pressure is maintained much lower relative to the region upstream along the extruder in order to facilitate removal of volatile materials from the extruded mixture. Optionally, steam 38 can be introduced into the extruder downstream from the point at which the ammonium hydroxide solution 25 is metered into the extruder but upstream from the venting region 30. The steam can thereby assist in removing nicotine from the tobacco material. Separately, binding agent 22 is solubilized in aqueous medium 40, which optionally can include a minor amount of glycerine or other humectant. The aqueous medium containing the solubilized binding agent is metered into the extruder 19 downstream from venting region 38, such that the desired level of moisture and binding agent are contacted with the tobacco material. The resulting moist mixture is subjected to extrusion conditions 42 to provide a well mixed, semi-soft, semi-solid material. The semi-soft, semi-solid material is passed through opening(s) in die 31, and the resulting extrudate 34 is collected. If desired, the extrudate exiting the extruder die can be subjected to treatment using a roller system 35, or to other physical treatment. Such optional physical treatment is particularly desirable for mixtures having moisture contents below about 40 weight percent. The resulting material is cooled to ambient temperature to yield resilient processed tobacco material 37 having a nicotine content less than that of tobacco material 10.

The extruders useful herein can vary. Although single screw extruders can be employed, preferred extruders are the twin screw extruders of which the co-rotating twin screw extruders are especially preferred. Of particular interest are the so-called "cooker extruders" which provide for heating of the materials which are introduced within the extruder. Various screw configurations can be employed. For example, screws having combinations of elements for feeding, mixing, pumping, shearing, and the like, can be selected as desired for optimum results. Screws having sections or elements which provide relatively large output capacities, which have interrupted or nonconjugated flights, or which are "counterflighted" or "reversing" also can be employed. Typical screw elements as well as screws having combinations of such elements are available from extruder manufacturers.

Suitable extruders are those extrusion means commercially available as Werner and Pfleiderer Continua 37 27:1 L/D, Wenger TX-52 34:1 L/D and Baker Perkins MPF-50/25:1 L/D. A Brabender single screw extruder equipped with a degassing port and an appropriate screw also can be employed. Operation of such extruders will be apparent to the skilled artisan.

The tobacco materials useful in this invention can vary. Typically, tobacco materials include tobacco fines, tobacco dust, tobacco laminae, tobacco cut filler, volume expanded tobacco, scrap tobacco which is recovered from various processing stages and cigarette manufacture stages, tobacco stems and stalks, scraps and/or sheets of reconstituted tobacco material, rolled tobacco stems, tobacco in essentially whole leaf form, and the like, as well as combinations thereof. The original sizes of the various pieces and particles of tobacco material are not particularly critical.

The term "essentially whole leaf form" is meant to include the entire leaf including the stem. Tobacco material in essentially whole leaf form includes cured tobacco provided from prize houses; and aged tobacco provided from bales, hogsheads and boxes. In particular, the total leaf including stem can be employed without throwing away any portion thereof. Generally, tobacco material in essentially whole leaf form includes tobacco which is not threshed or de-stemmed. However, it is desirable to clean or de-sand tobacco leaf using a screening technique or the like, prior to further processing steps.

Types of tobaccos useful herein most preferably include Burley, flue-cured, Maryland and Oriental tobaccos. Other types of tobaccos such as the rare or specialty tobaccos also can be employed. The various tobaccos can be employed separately or as blends thereof.

If desired, the tobacco material can be processed along with an amount of another filler material. For purposes of this invention, the term "filler material" relates to the tobacco material as well as to any other material capable of providing a portion of the volume of the extruded smokable material in addition to the tobacco material. Examples of suitable filler materials other than tobacco material include carbonized or pyrolyzed materials, tobacco substitute materials, organic filler materials such as grains, inorganic filler materials such as clays, calcium carbonate or aluminas, or other such materials, and blends thereof. The amount of other filler material which is employed relative to the tobacco material depends upon the desired smoking properties and physical characteristics of the ultimate smokable material.

The filler materials generally have a controlled particle size in order to optimize the efficiency with which the materials are extruded. Depending upon the size of the extrusion die, the filler materials have individual particle sizes of less than about 5 mesh. Typically, the tobacco materials and optional other filler materials are reduced in size so as to have individual particle sizes of less than about 30 mesh, preferably less than about 40 mesh, more preferably less than about 60 mesh, and most preferably less than about 100 mesh. The filler material is provided in a small size by grinding or otherwise reducing the size of the material using a grinder, a hammer mill, a ball mill or other suitable size reducing apparatus. The comminuted filler material can be transferred to the extruder without further processing. If desired, the size reduction steps can be performed within the barrel of the extruder using a high shear screw element or shear producing screw element.

If desired, flavorants, casing materials such as glycerine or other humectants, top dressing materials, or other flavor enhancing materials can be incorporated into the mixture which is ultimately extruded. Flavor enhancing materials can include the organic acids (e.g., levulinic acid), sugars, and the like. See, for example, *Tobacco Flavoring For Smoking Products,* by Leffingwell et al (1972). The flavor additives can be added at various stages of the process; and if desired, the flavor additives can be incorporated with the agent and then introduced into the extruder for contact with the filler material. The selection and levels of flavor additives which are employed will be apparent to the skilled artisan.

The specific modification of the tobacco material and selected component(s) which are displaced from the tobacco material in accordance with this invention can vary. However, the chemical composition of the tobacco material conveniently can be altered according to the process of this invention in that a certain amount of nicotine can be displaced from the tobacco material. As such, the process of this invention provides the skilled artisan with a convenient manner for providing denicotinization of tobacco material. By "denicotinization" is meant that a significant amount of the nicotine present in the tobacco material is removed therefrom. Typically, removal of more than about 5 weight percent, preferably more than about 10 weight percent, of the nicotine from the tobacco material is desirable for most denicotinization applications according to this invention. For methods for determining the nicotine content of tobacco, see Harvey et al, *Tob. Sci.,* Vol. 25, p. 131 (1981).

The agent which modifies the composition of the tobacco material or which displaces selected component(s) from the tobacco material can vary; and if desired, the agent can be a mixture of materials. However, an especially preferred agent is ammonia. Ammonia is employed to liberate or otherwise displace nicotine from the tobacco as well as modify the tobacco while the tobacco material is within the extruder. In particular, the ammonia can act in combination with moisture present within the extrusion means, as well as with any other fluid which is employed, in order to provide conditions for the ready release of selected component(s) from the tobacco. For example, a combination of ammonia and moisture can sufficiently modify the pH of the tobacco in order to readily provide for the displacement of nicotine from the tobacco. The ammonia can be provided in various forms. For example, the ammonia can be in a gaseous form, in an aqueous solution as ammonium hydroxide, or in solid form as ammonium carbonate. Other agents for displacing nicotine from the tobacco material can include hydrogen peroxide, potassium carbonate, sodium bicarbonate, and the like. Such agents stimulate or otherwise enhance the removal of nicotine from tobacco material.

The agent can be introduced into the extrusion means in a variety of ways. For example, filler material can be dry blended with an effective amount of a solid form of the agent, and then the resulting mixture can be introduced into the extrusion means; or the filler material and solid agent can be introduced into the extrusion means separately. Alternatively, the filler material can be introduced into the extrusion means through a first feed port, and a liquid solution or dispersion of the agent can be introduced into the extrusion means through a second feed port downstream from the first feed port. Furthermore, the filler material can be introduced into the extrusion means through a first feed port, and the agent in gaseous form can be introduced into the extrusion means through a second feed port downstream from the first feed port.

The amount of the aforementioned agent which is employed relative to the filler material can vary. The amount of agent employed can depend upon factors such as the properties of the agent, the selected component(s) which are to be modified or displaced, the amount to which such selected component(s) are modified or displaced, the extrusion conditions (e.g., temperature and pressure) to which the agent and filler material are subjected, and the like. In situations in which the agent is ammonia, it is typically convenient to employ from about 0.5 percent to about 5 percent, preferrably about 1 percent to about 3 percent of ammonia, based on the dry weight of the tobacco material which is processed therewith.

The moisture content of the filler material during extrusion, but prior to the time that the desired gaseous components are vented, can vary. If desired, the moist filler material can be combined with a nonaqueous fluid which is capable of complementing or enhancing the (i) modification of certain selected component(s) of the tobacco, or (ii) the displacement of certain selected component(s) from the tobacco. Such fluids can include carbon dioxide; alcohols such as methanol, ethanol, and isopropanol; halocarbons such as the commercially available freons; hydrocarbons such as propane, pentane and hexane; and the like. Typically, the filler material is processed at a total fluid content (e.g., which includes the moisture content) between about 20 percent and about 60 percent, preferably about 25 percent to about 35 percent, based on the total weight of materials processed within the extrusion means.

There can be various extrusion conditions which are sufficient to provide for displacement of selected component(s) from the tobacco material or which otherwise provide for a modification of the tobacco material. Such conditions provide a capability or otherwise allow the agent to act to displace selected component(s) from the tobacco. Typically, temperatures substantially above ambient conditions are useful in assisting in the particular release of component(s) from the tobacco material. For example, temperatures in the range from 80° C. to 170° C., preferably from 100° C. to 150° C., are desirable to provide for the denicotinization of tobacco material using ammonia as the aforementioned agent.

Pressures experienced within the extrusion means can vary. Generally, materials are processed above atmospheric pressure but below about 2,000 psig, more typically less than 1,500 psig. Typically, denicotinization of tobacco material using ammonia as the aforementioned agent conveniently can be performed at pressures above about 200 psig. The extrusion means should also be equipped such that the pressure built up therewithin can be rapidly decreased in the venting region such that volatiles (e.g., the aforementioned agent as well as the selected displaced component(s)) readily exit the extrusion means. Frequently, it is convenient to maintain the venting region at below atmospheric pressure such that gaseous materials are readily removed from the extrusion means. For example, the venting region can be maintained at a pressure from about 3 inch Hg to about 12 inch Hg below atmospheric pressure.

Depending upon factors such as the selection of the aforementioned agent and/or the fluid which is employed in conjunction with the moisture during extrusion, the temperature and pressure within the extrusion means can be selected such that the agent and/or fluid achieve a supercritical state. Such materials under supercritical conditions often can provide unique characteristics, and as such are capable of displacing selected component(s) from tobacco.

The filler material and agent are subjected to conditions for a period of time sufficient to provide for the displacement of selected component(s) from the tobacco material or otherwise provide for the chemical modification of the tobacco material. Generally, such a time period ranges from about 0.5 minute to about 3 minutes, preferably about 0.75 minutes to about 2 minutes, for most applications. Such time periods can vary depending upon the length of the extruder barrel, the extrusion conditions and the desired component(s) which are removed from the tobacco. Generally, screw configurations which provide adequate mixing and shearing of the tobacco material and the aforementioned agent allow the time period to be relatively brief.

Component(s) which are released from the tobacco material as well as any residual or unreacted agent are removed from the extruder separately from the extrudate. For most applications, the majority of the agent employed in the extrusion process is removed as residual, unreacted or excess agent. For example, nicotine can be entrained in a water vapor/ammonia mixture and vented or otherwise exhausted from the extruder prior to the time that the filler material is passed through the extrusion die. If desired, steam can be introduced into the extruder barrel downstream from the point at which the aforementioned agent is introduced into the barrel but upstream from the venting region. The steam can assist in stripping away component(s) to be removed from the tobacco and thus maximize the release of such component(s) from the tobacco. The venting of the vapors conveniently can be provided through a venting port or other such means which is conventional in extrusion technology. As the vapors are isolated separately from the collected extrudate, the extrudate often can have (i) negligible levels of residual or unreacted ammonia therein, or (ii) such low levels of residual or unreacted ammonia therein that the ammonia present is not dissonate to the organoleptic characteristics associated with the ultimate smokable material.

The screw configuration of the extrusion means in the region where the vaporous mixture is vented conveniently can have a large output capacity in order to provide a low degree of filling of the screw in the venting region. As such, the low filling ratio of filler material within the extruder barrel at the venting region provides for a low degree of pressure which is exerted by the filler material such that flooding of the venting port with the filler material is minimized or eliminated. Typically, a screw configuration having interrupted or nonconjugated flights in the venting region can provide the desired large output capacity to diminish the degree to which the screw is filled while providing for a desired mixing of the filler material such that vaporous materials trapped therein can be conveniently released in the venting region. A vacuum can be applied at the venting region in order to assist in removing the vented vapors from the extruder.

The vented vapors which are released from the extruder are destroyed or otherwise disposed of, condensed, trapped, or otherwise recovered or isolated. For example, a vaporous mixture of water, ammonia and nicotine can be cooled, bubbled through an acid solution, and exhausted. Alternatively, the vapors can be passed through adsorbent materials such as carbon, alumina, acidified silica gel, or the like, in order that the ammonia and nicotine vapors can be removed from the airstream.

A binding agent is useful herein in order to provide for cohesion of the various particles of filler material to one another thereby yielding an extrudate of good physical properties. A wide variety of binding agents can be employed herein. However, a preferred binding agent useful herein includes a mixture of locust bean gum and xanthan gum. A mixture of solubilized locust bean gum and xanthan gum heated above about 80° C. can reversibly form a gel after cooling a heated aqueous mixture thereof to below the gel point of the binding agent (i.e., to below a temperature of about 55° C.).

A suitable binding agent can include about 15 percent to about 75 percent locust bean gum, preferably about 25 percent to about 65 percent locust bean gum, more preferably about 40 percent to about 60 percent locust bean gum; and about 25 percent to about 85 percent xanthan gum, preferably about 35 percent to about 75 percent xanthan gum, more preferably about 40 percent to about 60 percent xanthan gum, based on the total weight of the binding agent. It is preferable that the binding agent be employed at between about 0.2 and about 6 percent, more frequently less than about 5 percent, and more preferably between about 1 and about 4 percent, and most preferably between about 2 to about 3 percent, based on the total weight of binding agent and filler material dry weight.

The comminuted tobacco material, optional other filler material and the binding agent are contacted with one another in a manner which can vary. For example, the binding agent can be employed in a substantially dry, non-activated form, and can be added bulk-wise to the comminuted filler material. For example, the binding agent is dispersed within or mixed with the filler material, and then the desired level of moisture is applied to the mixture. If desired, the mixing of dry binding agent and comminuted filler material can be performed in the barrel of the extruder. However, mixing of the materials can occur before the materials are fed into the extruder. As another example, the binding agent is mixed with moisture and subjected to conditions such that binding agent components are solubilized. Then the solubilized binding agent is fed into the extruder and subjected to mixing with the filler material.

As used herein, the term "solubilize" in referring to the binding agent components is meant to include the ability of the components of the binding agent to be hydrated, partially hydrated, or uniformly distributed throughout the aqueous solvent.

As used herein, the term "activation" in referring to the binding agent is meant to include the introduction of the latent adhesive properties to the binding agent. For example, the latent adhesive properties of the binding agent are the adhesive properties which arise upon heating the solubilized components of the locust bean gum/xanthan gum binding agent above some activation temperature. Activation can be provided by heat in combination with moisture, pressure, shear energy, or other such physical parameters. For example, upon activation, the binding agent begins to behave generally as an adhesive which is capable of forming a gel upon cooling and thereby adhering filler material together. Generally, a mixture of moist tobacco and activated binding agent exhibits a semi-soft, formable, somewhat consistent, or somewhat dough-like character, and can be somewhat sticky or tacky in nature. It is believed that the components of the locust bean gum/xanthan gum binding agent exhibit a synergistic binding character as a result of interpolymer chain associations which are believed to occur between the component binders. Such interpolymer chain associations are believed to be initiated by subjecting the component binders of the binding agent to the temperatures and conditions which provide activation of the binding agent.

The moisture content of the filler material/binding agent mixture prior to exiting the extrusion die can vary. The mixture has a moisture content such that the mixture has a semi-soft, semi-solid character suitable for extruding. Typically, a low moisture content mixture requires a greater amount of energy in order to ultimately provide extruded product; while a high moisture content mixture yields a product of poor tensile strength or requires undesirable energy intensive drying processes. Typically, the tobacco material, optional filler material and the binding agent are processed such that the moisture content thereof upon exiting the extrusion die is at least about 15 weight percent, preferably at least about 17 weight percent; but most frequently is less than about 45 weight percent, preferably less than about 40 weight percent, more preferably less than about 30 weight percent. Typically, the moisture content of the filler material and binding agent upon exiting the extrusion die is between about 18 weight percent and about 25 weight percent.

The moistened filler material/binding agent mixture is subjected to extrusion conditions. Extrusion conditions can vary, but generally involve a mixing of materials at temperatures above ambient temperature within the barrel of the extruder followed by a forcing of the mixed materials through the opening(s) or orifice(s) in the die of the extruder.

The extrudate exits the die opening(s) or orifice(s) of the extruder at a temperature which is greater than that at which the binding agent forms a gel. For example, in situations wherein the binding agent is a mixture of locust bean gum and xanthan gum, the extrudate should exhibit a temperature above about 55° C. immediately upon exiting the die orifice. However, it is preferred that the extrudate which exits the die exhibit a temperature in excess of about 100° C. Under such conditions, extrudate normally having a moisture content of about 15 to about 35 weight percent is collected, depending upon the initial moisture content of the extruded mixture. Typically, the extrudate cools rather quickly causing the binding agent to gel thereby yielding a resilient smokable material. The cooled material is springy and flexible, and can be easily handled. Extrudate of low moisture content typically is more rigid in character than extrudate of higher moisture content.

The extrudate can be collected as is, and employed in the manufacture of smoking articles. For example, the extrudate can be collected in a bin or other suitable container, or deposited onto a moving belt or other conveyor means. If desired, the extrudate can be chopped into short strands or shreds. Oftentimes, the extrudate can be continuous strands which are immediately chopped into short strands or shreds using a rotating knife, or the like. The extrudate can be subjected to treatment using pressure rollers in order to provide compressive treatment to reduce the thickness thereof. When a xanthan gum/locust bean gum binding agent is employed, it is preferable to subject the extrudate to physical treatment (e.g., using pressure rollers, or the like) while the extrudate is warm (e.g., immediately after leaving the die) and before the binding agent begins to cool and gel. For example, the die can have a configuration such that the extrudate is directly fed into the nip zone of a pair of rollers in roll contact. Typical roll treatment is provided using roller systems having very high separation forces.

After processing steps are complete, the extrudate can be dried to moisture levels between about 10 weight percent to about 15 weight percent for further use.

The extrudate which is provided according to the process of this invention can be provided in a variety of shapes. The shape of the extrudate generally is dependent upon the configuration of the extruder die, as the die is determinative in imparting the desired shape to the resulting smokable material. The extrudate can have the form of strand, flake, sheet, a tube, a cylinder, a cylinder having a series of passageways extending longitudinally therethrough, a cylinder having a honeycomb-like cross sectional shape, or any other desired shape. As the shape and components of the extrudate can vary considerably, the extrudate can be employed in the manufacture of a variety of smoking articles.

The extrudate can be provided generally in the form of a sheet. The sheet-like material exhibits good flexibility and tensile strength. By the term "sheet" as used herein is meant that the material is in a form wherein the length and width thereof are substantially greater than the thickness thereof. Typically, the thickness of the sheet approximates that of tobacco leaf, cured or processed tobacco leaf, or wet reconstituted tobacco sheet product. For example, the thickness of the sheet preferably ranges from about 0.002 inch to about 0.02 inch, more preferably from about 0.002 inch to about 0.008 inch. The length and width of the sheet or strip of processed material can vary. The width of the sheet generally is determined by factors such as the extrusion die configuration, or the physical treatment of the extrudate. The sheet-like material most desirably exhibits good flexibility and tensile strength. Typically, the processed sheet having a thickness comparable to tobacco laminae exhibits a structural strength which approaches that of tobacco laminae. It is most desirable that the sheet exhibit good physical properties while being as thin as possible. The sheet can be cut as are tobacco leaf laminae or wet formed reconstituted tobacco material (e.g., in strands or shreds at about 32 cuts per inch) using various conventional cutting devices. The extrudate can be cased, top dressed and treated with numerous flavorants, mixed with other smokable materials, and employed as cut filler in the manufacture of cigarettes.

The extrudate can be provided generally in shredded form or the form of a strand. The extrudate in shredded or strand form most desirably exhibits good flexibility and tensile strength. Preferably, such a material has physical dimensions comparable to tobacco cut filler, exhibits a structural strength which approaches that of tobacco cut filler; and can be processed with conventional cut filler in a cigarette making operation without the loss of substantial structural integrity. The thickness of the shredded material or strand is comparable to that of the previously described sheet-like material. For most applications, the width of each shred or strand is comparable to that of cut filler. However, strands having a cross sectional shape which is circular, square, rectangular, oval, trapezoidal, or the like can be provided depending upon the die configuration. Strands can be engineered using the process of this invention in order to exhibit significant amounts of crimp or curl in order to improve the packing density thereof.

The following example is provided in order to further illustrate various embodiments of the invention but should not be construed as limiting the scope thereof. Unless otherwise noted, all parts and percentages are by weight.

EXAMPLE 1

Extruded tobacco is provided as follows.

Flue-cured tobacco has a nicotine content of 3.49 percent, a total sugars content of 12.5 percent and a reducing sugars content of 11.0 percent. The tobacco has a specific ammonia content of 0.05 percent. The tobacco is comminuted using a hammer mill to provide finely divided tobacco material of 60 mesh. The moisture content of the divided material is about 11 percent.

A Werner and Pfleiderer Continua 37 27:1 L/D twin screw extruder is provided. The extruder includes two identical screws which are offset in rotation in order to intermesh. Each screw has a diameter of 3.7 cm and is operated at a screw speed of 275 rpm using a 7.6 kw motor. The twin screws each have a combination of elements positioned in a series beginning adjacent the motor and ending adjacent the die. The screws each include a degassing feed element of 9 cm length, a feed screw of 10 cm length, 4 30° forward paddles each of 1 cm length, a feed screw of 5 cm length, 4 30° forward paddles each of 1 cm length, 2 30° reverse paddles each of 1 cm length, a feed screw of 5 cm length, a reverse element of 1 cm length, a forward element of 1 cm length, a reverse element of 1 cm length, a forward element of 1 cm length, a feed screw of 5 cm length, a short pitch screw of 4 cm length, 2 30° forward paddles each of 1 cm length, 4 30° reverse paddles each of 1 cm length, a reverse screw of 2 cm length, a feed screw of 3 cm length, a degassing screw of 9 cm length, a feed screw of 5 cm length, 2 30° forward paddles each of 1 cm length, a reverse element of 1 cm length, a forward element of 1 cm length, a reverse element of 1 cm length, a forward element of 1 cm length, a feed screw of 5 cm length, a short pitch screw of 4 cm length, and a feed screw of 8 cm length adjacent the die. The die is a round metal plate having a thickness of about 1.6 cm, diameter of about 9.25 cm and one round orifice having a diameter of 6 mm.

The extruder has three controlled temperature zones. The temperature zone adjacent the motor is cooled by tap water and extends about 15 cm along the barrel of the extruder. The second temperature zone extends about 50 cm along the barrel in the region between the first temperature zone to the third temperature zone. The temperature within the second zone is maintained at about 155° C. The third temperature zone extends about 30 cm along the barrel from the second temperature zone to a region adjacent the die. The temperature within the third zone is maintained at about 155° C.

A dry blend of the comminuted tobacco material and granular binding agent is fed into a first feed zone of the extruder at a rate of 7.26 kg/min. The central portion of the first feed zone is spaced about 5 cm from the extreme input end of the screw. The blend is 97 parts comminuted tobacco material and 3 parts binding agent. The binding agent is a mixture of 1 part locust bean gum and 1 part xanthan gum.

An aqueous solution of ammonium hydroxide is fed into a second feed zone of the extruder at a rate of 3.48 liters/hr. The second feed zone is a port spaced about 12 cm from the extreme input end of the screw. The solution is 95.8 parts water and 4.2 parts ammonium hydroxide.

A pressure probe is positioned about 60 cm from the extreme input end of the screw. The pressure within the barrel as measured at that point is maintained at about 247 psig.

A venting region is positioned about 69 cm from the extreme input end of the screw. A pressure of 4 inch Hg below atmospheric is maintained in the venting region. A tube from the venting region provides for passage of the vented vapors through a cooled flask to condense vapors and then through a diluted aqueous solution of hydrochloric acid. The vented vapors are bubbled through the hydrochloric acid solution, and the remaining vapors are exhausted through a laboratory vacuum line. Nicotine and ammonia are collected in the acid solution.

A temperature probe is positioned about 76 cm from the extreme input end of the screw. The temperature of the process material within the barrel as measured at that point is about 127° C.

A cylindrical rod of processed tobacco exits the die and is allowed to fall about 15 cm into the nip of a pressurized roller system. The roller system consists of two rollers in roll contact, each roller having a diameter of 15.25 cm and a length of 15.25 cm. The rollers are maintained in roll contact by hydraulic means and a roll clamp pressure of 600 psi is applied. The rollers are counter rotating such that the extrudate which is fed into the nip of the rollers is passed therethrough. One roller is rotated at 75 rpm while the other is rotated at 39 rpm. The cylindrical extrudate which enters the roller system exits the roller system having a sheet-like shape (i.e., having a width of about 2 inches and a thickness of about 0.005 inch).

The sheet-like extrudate is cooled and allowed to dry to a moisture level of about 12 percent to about 13 percent. The extrudate exhibits good physical strength. The material can be divided into shreds or strands and used as cut filler for cigarette manufacture.

The extrudate exhibits a nicotine content of 3.04 percent, a total sugars content of 11.0 percent and a reducing sugars content of 9.9 percent. The glucosamine content of the extrudate is about 3.5 times higher than that glucosamine content of the tobacco prior to the processing steps of the invention. The extrudate has a specific ammonia content of 0.56 percent.

For comparison purposes, a similar mixture of divided tobacco and binding agent is similarly processed, except that the mixture is not subjected to treatment with the ammonium hydroxide solution. The resulting extrudate exhibits a nicotine content of 3.40 percent, a total sugars content of 12.2 percent and a reducing sugars content of 10.9 percent. The glucosamine content of the extrudate is essentially unchanged relative to the tobacco prior to the processing steps. The extrudate also exhibits a specific ammonia content of 0.05 percent. Any changes in the chemical composition of the tobacco during such an extrusion process are considered insignificant.

The example illustrates that tobacco can be processed into an engineered form while selectively altering its chemical composition to a significant degree.

What is claimed is:

1. A process for providing smokable extrudate, the process comprising:

(a) providing filler material, at least a portion of which is tobacco material;

(b) providing an agent capable of displacing selected component(s) from the tobacco material;

(c) subjecting the filler material and the aforementioned agent to extrusion conditions using extrusion means, the extrusion conditions being sufficient to provide for displacement of selected component(s) from the tobacco material; and (d) separately (i) removing from the extrusion means, during extrusion, component(s) displaced from the tobacco material, and (ii) providing extrudate.

2. The process of claim 1 whereby the filler material and the agent are separately introduced into the extrusion means.

3. The process of claim 2 whereby the filler material is introduced into the extrusion means prior to the time that the agent is introduced into the extrusion means.

4. The process of claim 2 whereby the filler material is continuously introduced into the extrusion means, and the agent is continuously introduced into the extrusion means downstream from the point at which the filler material is introduced into the extrusion means.

5. The process of claim 2, 3, or 4 whereby the agent is provided in gaseous or liquid form.

6. The process of claim 1, 2, 3 or 4 whereby the agent is ammonia and the selected component is nicotine.

7. The process of claim 1, 2, 3 or 4 whereby the extrusion conditions include subjecting the filler material and agent to a temperature of from 80° C. to 170° C.

8. The process of claim 1, 2, 3 or 4 whereby the filler material is subjected to extrusion conditions in the presence of a xanthan gumand locust bean gum binding agent.

9. The process of claim 1 whereby the pressure within the extrusion means is lower in the region where the component(s) displaced from the tobacco material are removed from the extrusion means, relative to a region upstream along the extrusion means.

10. The process of claim 1, 2, 3 or 4 whereby essentially all of the filler material is tobacco material.

11. The process of claim 1, 2, 3 or 4 whereby essentially all of the filler material is flue-cured tobacco material and the agent is ammonia.

12. The process of claim 1, 2, 3 or 4 whereby essentially all of the filler material is Burley tobacco material and the agent is ammonia, the process further including providing at least one sugar additive along with the ammonia.

13. The process of claim 1 whereby the agent is ammonia.

14. A process for providing smokable extrudate, the process comprising:

(a) providing filler material, at least a portion of which is tobacco material;

(b) providing an agent capable of modifying the chemical composition of the tobacco material;

(c) subjecting the filler material and the aforementioned agent to extrusion conditions using extrusion means, the extrusion conditions being sufficient to provide for modification of the chemical composition of the tobacco material; and (d) separately (i) removing from the extrusion means, during extrusion, residual agent, and (ii) providing extrudate.

15. The process of claim 1 whereby the component(s) displaced from the tobacco material includes nicotine, and more than about 10 weight percent of the nicotine present in the tobacco material is removed therefrom.

16. The process of claim 1 whereby the component(s) displaced from the tobacco material includes nicotine, and more than about 5 weight percent of the nicotine present in the tobacco material is removed therefrom.

17. The process of claim 14 whereby the filler material and the agent are separately introduced into the extrusion means.

18. The process of claim 17 whereby the filler material is introduced into the extrusion means prior to the time that the agent is introduced into the extrusion means.

19. The process of claim 17 whereby the filler material is continuously introduced into the extrusion means, and the agent is continuously introduced into the extrusion means downstream from the point at which the filler material is introduced into the extrusion means.

20. The process of claim 17, 18 or 19 whereby the agent is provided in gaseous or liquid form.

21. The process of claim 14, 17, 18 or 19 whereby the extrusion conditions include subjecting the filler material and agent to a temperature of from 80° C. to 170° C.

22. The process of claim 14, 17, 18 or 19 whereby the filler material is subjected to extrusion conditions in the presence of a xanthan gum and locust bean gum binding agent.

23. The process of claim 14 whereby the pressure within the extrusion means is lower in the region where the residual agent is removed from the extrusion means, relative to a region upstream along the extrusion means.

24. The process of claim 14, 17, 18 or 19 whereby essentially all of the filler material is tobacco material.

25. The process of claim 1 or 14 whereby the agent is hydrogen peroxide.

26. The process of claim 1 or 14 whereby the agent includes carbon dioxide.

27. The process of claim 1 or 14 whereby the agent is potassium carbonate.

28. The process of claim 1 or 14 whereby the agent is sodium bicarbonate.

29. The process of claim 1 or 14 further including introducing steam into the extrusion means downstream from the region where the agent is introduced but upstream from the region where the component(s) displaced from the tobacco are removed from the extrusion means.

30. The process of claim 1 or 14 whereby the extrusion conditions include a pressure above about 200 psig within the extrusion means.

31. The process of claim 1 or 14 whereby the pressure within the extrusion means in the region where the component(s) displaced from the tobacco material are removed from the extrusion means is less than atmospheric pressure.

* * * * *